US006048227A

United States Patent [19]

Rupp et al.

[11] Patent Number: 6,048,227

[45] Date of Patent: Apr. 11, 2000

[54] CONNECTOR BACKSHELL

[75] Inventors: Bernard Rupp, Remseck; Herbert Sommer, Weinstadt; Erich Straub, Weinstadt; Richard Fenske, Weinstadt, all of Germany

[73] Assignee: ITT Manufacturing Enterprises, Inc., Wilmington, Del.

[21] Appl. No.: 09/100,519

[22] Filed: Jun. 19, 1998

[30] Foreign Application Priority Data

Jun. 19, 1997 [DE] Germany ..... 197 26 005

[51] Int. Cl.[7] ..... H01R 9/03

[52] U.S. Cl. ..... 439/610

[58] Field of Search ..... 439/610, 462, 439/583–5, 905, 98, 99, 578

[56] References Cited

U.S. PATENT DOCUMENTS 4,243,290 1/1981 Williams .
4,854,891 8/1989 Kamei et al. ..... 439/462
5,888,097 3/1999 DiCicco ..... 439/610

FOREIGN PATENT DOCUMENTS 90 15 056 U 11/1990 Germany .
94 00 217 U 1/1994 Germany .

*Primary Examiner*—Neil Abrams
*Assistant Examiner*—Eugene G. Byrd
*Attorney, Agent, or Firm*—Thomas L. Peterson

[57] ABSTRACT

The description relates to a backshell for a connector, consisting of a cylindrical metallic part (1) in which the cable (20) comprising a screening braid (21) is inserted and which comprises means for establishing electrical contact between the screening braid and the backshell. A non-metallic sleeve (2) is provided inside the backshell (1), which sleeve comprises webs (3) which extend substantially axially and are resilient radially to deflect inwards. A metallic clamping ring (4) is also provided, one end (4B) of which can be pushed over the webs (3) in the axial direction such that the screening braid (21) is clamped between the webs (3) and the clamping ring (4). A contact face of the clamping ring (4) bears against a pressure face (1B) of the backshell (1).

12 Claims, 2 Drawing Sheets

CONNECTOR BACKSHELL

CROSS REFERENCE

This application claims priority from German patent application no. 197 26 005.5-34 filed Jun. 19, 1997.

BACKGROUND OF THE INVENTION

The invention relates to a backshell for a connector, the backshell consisting of a cylindrical metallic part in which a cable comprising screening braid is inserted and which comprises means for establishing electrical contact between the screening braid and the backshell.

A backshell of this kind has to meet several requirements: Reliable electrical contact must be established with the screening braid of the cable in order to guarantee the electromagnetic compatibility required by various standards. It should also be as easy as possible to manufacture and assemble and provide strain relief for the cable.

In a known backshell of the above type (cf. Techn. Information TL-EMV of the firm PFLITSCH GmbH & Co. KG, p. 20) contacting is effected by pressing the screening braid between the inclined faces of two cones. In this case a spring which presses the two cones towards one another must be provided inside the backshell, and there is a risk of individual detached stranded wire pieces or free stranded wire ends coming into contact with the earthed, or grounded parts of the backshell.

In another known backshell of the type initially mentioned (Techn. Information . . . , as above, p. 7) contact is effected via a helical continuous spring which is inserted between two metallic contact elements where the spring, is disposed in the circumferential direction and presses onto the screening braid of the cable when compressed inwards. This seal also requires a relatively high number of parts; a further disadvantage is that contact is jeopardised by the setting behaviour of the spring with increasing aging.

In addition, as already mentioned, the cable must be provided with a strain relief in backshells of this kind.

This means that a pull acting on the cable should not be transmitted to the electrical contacts and take effect at the latter, but must instead be absorbed beforehand through a connection between the cable sheath and the backshell. Because of the mechanical structure, together with the measures for creating suitable electrical contact, the safeguards against pull are often inadequate in the known backshells.

The object of the invention is to provide an improved backshell of the type initially mentioned.

SUMMARY OF THE INVENTION

This object is achieved according to the invention in that a sleeve is provided inside the backshell, which sleeve comprises webs which extend substantially axially and are resilient radially inwards, and that a metallic clamping ring is also provided, one end of which can be pushed over the webs in the axial direction such that the screening braid of the cable is clamped between the webs and the clamping ring, and that a contact face of the clamping ring bears against a pressure face of the backshell.

The invention also relates to various advantageous developments, which are defined in the subclaims.

A backshell of this kind establishes a reliable direct connection between the screening braid of the cable and the backshell; in this respect assembly is particularly simple due to the snap effect when drawing the screening braid over the resilient webs of the sleeve and requires comparatively few individual parts. Moreover, it is particularly easy to integrate a seal conforming to protective system IP 67 according to DIN 40050 into a backshell of this kind. It is equally possible to provide a strain relief in a particularly favourable manner, this being achieved by means of the components which also take effect when the sealing ring is compressed. It is particularly important in this respect for the electrical connection of the screening braid and the backshell to be established and the strain-relieving elements to be sealed and engaged through the same operation of screwing the backshell to the shell of a part of a connector.

The sleeve which is provided as part of the invention and which expediently consists of a plastics material protects any stranded parts having broken off during assembly or prior to this against contact with the backshell, as the space in which the signal-carrying lines (strands) run is screened. This conforms to the safety provisions of VDE standard 0627.

The components may also be formed such that like parts can be provided in a series with different numbers of connections.

The screening braid of a cable is drawn externally over the resilient webs, which are formed by slotting, of the plastics sleeve and secured with a snap effect by means of the metallic clamping ring. The good electrical connection is effected by the screening braid pressing at the clamping ring against the webs and the contact face of the clamping ring bearing against the pressure face of the backshell. The cable clamp, which is formed as a slotted resilient plastics clamping ring, produces a strain relief, as the cable clamping elements are compressed and thus pressed onto the outer sheath of the cable when the backshell is screwed on. The sealing ring is at the same time compressed radially against the cable sheath.

A backshell of this kind, as provided by the invention, can be used for all circular connectors.

DESCRIPTION OF THE PREFERRED EMBODIMENTS

Figure 1:
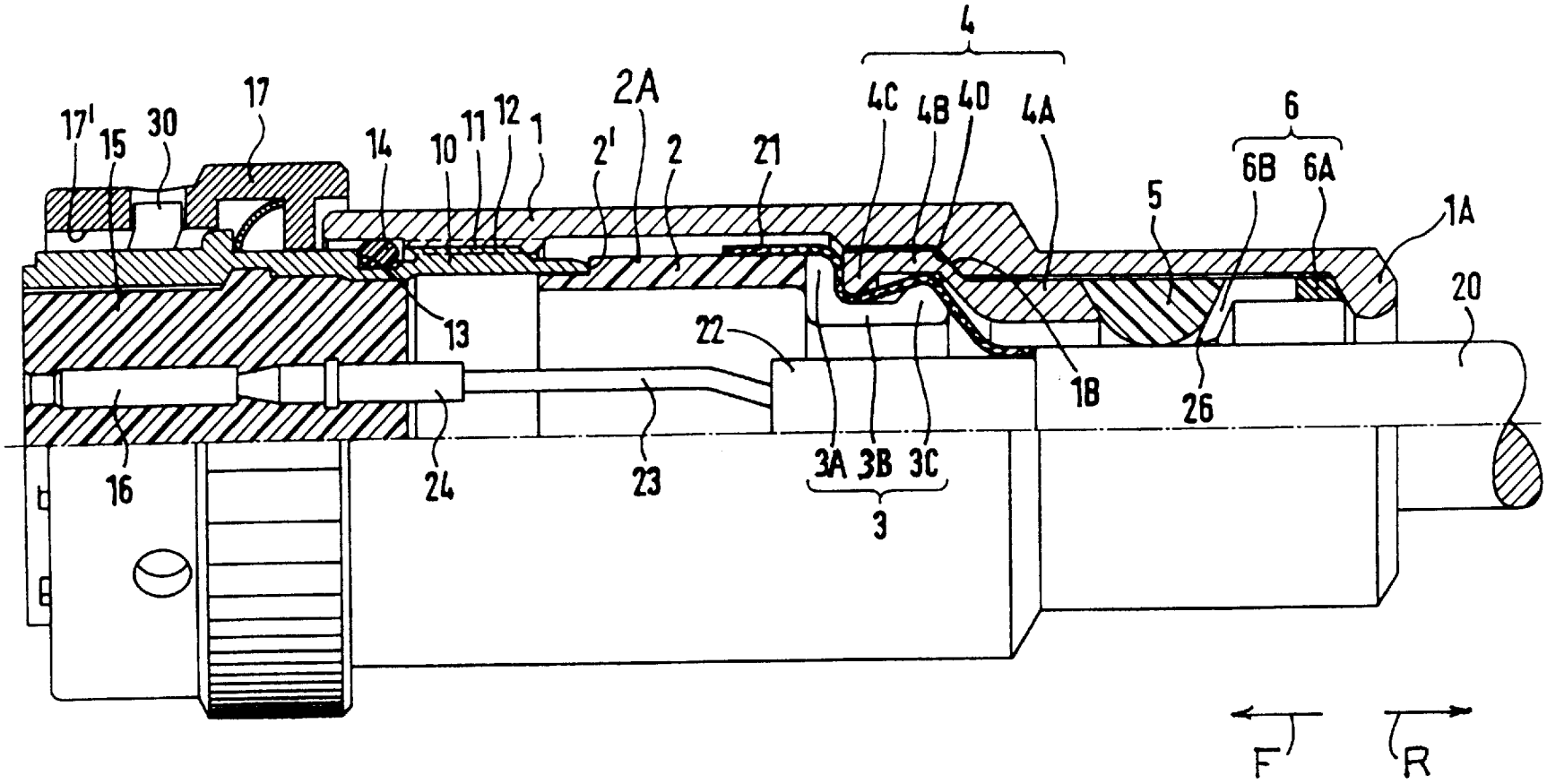
FIG. 1 is a partial, longitudinal sectional view of a connector of the present invention.

FIG. 1 illustrates a connector 50 which includes a metal backshell 1. The backshell 1 surrounds a sleeve 2 of a plastics material whose right-hand end (in the figure) has a plurality of axially-extending slots, to form a plurality of resilient webs or fingers 3 that are integral with a front or left-hand end of the sleeve 2. The form of these webs 3 is such t-hat a part 3A extending substantially radially inwards is firstly provided subsequent to the sleeve 2, and a part 3B extending substantially in the axial direction is provided subsequent to the part 3A. A bead 3C is formed at the end of each part 3B. A metallic clamping ring 4 adjoins the sleeve 2 with the webs 3 to the right in the axial direction, which ring comprises a bead 4C on the inside at its end which faces the part 3B. This bead 4C is located on a part 4B extending in the axial direction. Subsequent to the part 4B the clamping ring comprises an inclined region with a contact face 4D. The region 4A adjoins the latter in the axial direction. A sealing ring 5, which has a semicircular cross section and is provided with a notch, adjoins the right-hand end of the clamping ring 4. This sealing ring is followed by a cable clamp 6 of a plastics material with a region 6A extending in the axial direction and by adjoining cable clamping elements 6B, which are formed by slotting the cable clamp and are bent radially inwards.

The sleeve 2 comprises a stop 2' at its left-hand end. The cylindrical shell 10 of a first part of a connector bears against this stop, onto the external thread 12 of which shell the backshell 1 is screwed with its internal thread 11. A sealing ring 14, e.g. an O-ring, is disposed in a groove 13 in the shell 10 and forms a seal with respect to the inner face of the backshell 1 when the parts are screwed together. An insulating body 15 is located in the shell 10. Contact elements 16 (e.g. pin bushings) are located in this insulating body. The second part of the connector, which, together with the first part, is formed by the components 10, 15, 16, is not shown for the sake of simplicity. It comprises further contact elements (e.g. pins) which are associated with the contact elements 16 and are assembled with these. A coupling nut 17 is mounted on the shell 10, this nut being provided at its face 17' either with an internal thread or with a bayonet catch, so that a metallic connection with the other part (not shown) of the connector is thus established.

In order to connect the backshell to a cable 20, the outer sheath of the latter, if provided, is stripped to an extent such that a piece of the screening braid 21 which surrounds the internal cable 22 is exposed. The cable wires 23 are exposed at their ends, these being connected to the connecting elements 24 by soldering, crimping or some other way. The connecting elements 24 are connected to the contact elements 16.

The next step is to insert the sleeve 2 in a forward direction F such that the stop 2' bears against the end of the shell 10, after which the screening braid 21 is drawn over the webs 3, in particular over the beads 3C, until the end of the screening braid 21 lies on the outside of the sleeve 2, as illustrated. The metallic clamping ring 4 is then mounted, this "snapping into" the illustrated position when its bead 4C is pushed over the bead 3C, which then yields resiliently inwards. In order to guarantee this, the outside diameter of the beads 3C of the fingers is slightly greater than the inside diameter of the bead 4C. This snap effect facilitates the assembly process. The sealing ring 5 and the cable clamp 6 are then mounted. Finally, the backshell 1 is mounted and screwed to the shell 10. The entire internal arrangement, consisting of the sleeve 2 with webs 3, clamping ring 4, sealing ring 5 and cable clamp 6, are in the process compressed in the axial direction, as the end 1A which is drawn in pushes the entire arrangement against the shell 10.

The following happens when the parts are screwed together:

(a) The bead 4C of the metallic conical ring 4 creates reliable electrical contact with the screening braid 21. At the same time the inclined contact face 4D of the clamping ring 4 creates good electrical contact with the associated pressure face 1B, also inclined, of the backshell 1, this contact extending to the mating connector (not shown) via the threaded connection between the backshell 1 and the shell 10 through the bayonet path or thread of the coupling nut 30. This achieves a good electrical connection between the screening braid 21 and the mating connector via the shell 10 and the coupling nut, thus guaranteeing enclosed screening of the connector pair, connector and mating connector.

(b) in addition, upon screwing on the backshell 1 the sealing ring 5 is compressed such that it distends radially inwards and forms a seal at the cable 20.

(c) Finally, upon screwing on the backshell the cable clamping elements 6B, which extend radially inwards at an inclination, are pushed inwards, so that their pointed ends 26 dig into the outer sheath of the cable 20. A strain relief for the cable 20 is thus produced.

Figure 2:
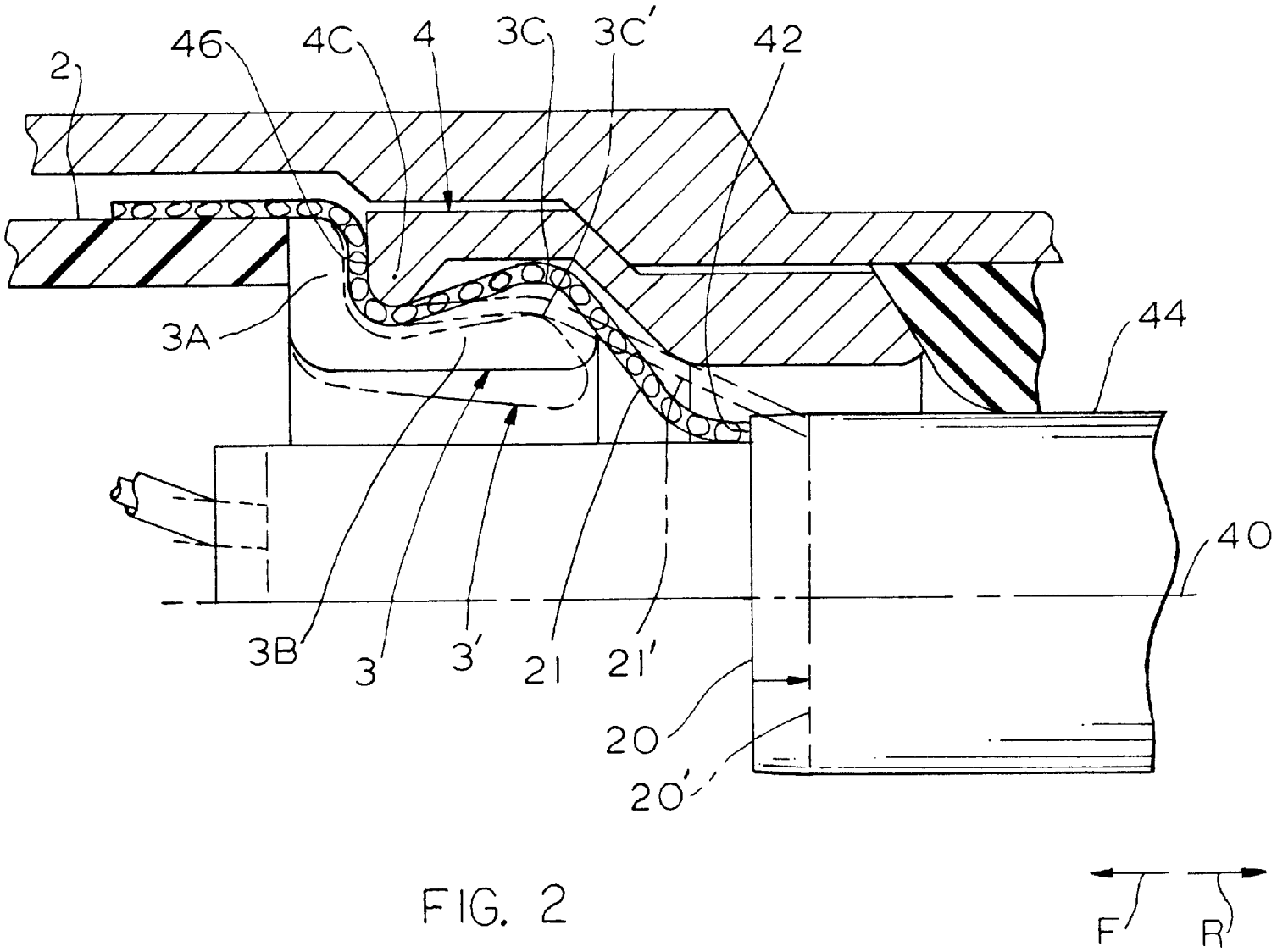
FIG. 2 is an enlarged view of a portion of FIG. 1, and showing, in phantom lines, the rearward shift of the cable and its effect.

FIG. 2 shows the cable 20 after it has been shifted in a rearward direction (R) along the connector axis 40 to the position 20'. It can be seen that the fingers 3 have deflected radially inward to the positions 3' by increased tension in the cable shield as its configuration changes to 21'. The front of the cable shield continues to be clamped between a clamping location 46 on the bead 4C of the clamping ring 4 and the part 3A of the sleeve 2. Thus, the deflectable finger 3 formed by slots, provide strain relief for the cable.

The outside diameter of the bead 3C of the finger is greater than the initial diameter of the shield at the location 42 where the shield emerges from the cable jacket 44 at the front end of the cable jacket. This allows the fingers to deflect inwardly towards the axis 40.

What is claimed is:

1. A connector for connection to a cable that extends rearwardly from the connector and that has a flexible cable shield of predetermined initial diameter and at least one wire lying within said cable shield and having a projecting wire end, where said connector has an axis extending in forward and rearward directions and includes a housing with a metal shell, an insulator lying within said housing, and at least one contact lying in said insulator for connection to said wire, where said connector includes a sleeve with a rear sleeve region around which said shield can be wrapped and said housing includes a metal clamping ring which can be slid forward during assembly to firmly clamp said shield against a clamp location on said rear sleeve region to establish good electrical contact between said shield and said clamp, with said clamping ring being electrically connected to said shell, wherein:

said sleeve rear region has a plurality of fingers with rear portions of greater diameter than said shield initial diameter and lying rearward of said clamping location, with said fingers being resiliently deflectable toward said axis to provide strain relief for said shield.

2. The connector described in claim 1 wherein:

each of said fingers has a radially outwardly-projecting finger bead forming its rear end, and said clamping ring has a radially inwardly-projecting bead lying forward of said finger beads and of smaller inside diameter than the outside diameters of said finger beads.

3. The connector described in claim 1 wherein:

said sleeve has a front portion lying forward of said fingers and of greater radius than the average radius of said fingers.

4. The connector described in claim 1 wherein:

said clamping ring is a component that is separate from said shell, with said shell and said clamping ring each having an inclined contacting surface for direct face-wise engagement of the other inclined contact surface when the connector is assembled.

5. The connector described in claim 1 wherein:

said clamping ring is constructed to press said shield forwardly against said clamp location on said sleeve;

said sleeve front portion has a forwardly-facing stop surface, and said housing includes a stop that directly abuts said stop surface to positively fix the forward axial position of said sleeve.

6. The connector described in claim 1 wherein said cable has an outside jacket, and including:

a cable clamp lying rearward of said clamping ring and having a rear region (6A) and a plurality of tines (6B) with front portions extending at a forward and radially inward incline to lie against and grasp said cable jacket.

7. A combination of a connector and a cable that extends rearwardly from the connector, where the cable has a cable jacket, a flexible cable shield of predetermined initial diameter extending forward of said sheath, and at least one wire having a projecting wire end, where said connector has an axis extending in forward and rearward directions and includes a housing with a metal shell, an insulator lying within said housing, and at least one contact lying in said insulator for connection to said wire, where said connector includes a sleeve with a rear sleeve region and said housing includes a metal clamping ring which firmly clamps said shield forwardly against a clamp location on said rear sleeve region to establish good electrical contact between said shield and said clamp, with said clamping ring being electrically connected to said shell, wherein:

said sleeve rear region has a plurality of fingers with rear portions of greater diameter than said shield initial diameter and lying rearward of said clamping location, with said fingers being resiliently deflectable toward said axis to provide strain relief for said shield.

8. The combination described in claim 7 wherein:

each of said fingers has a radially outwardly-projecting finger bead forming its rear end, and said clamping ring has a radially inwardly-projecting bead lying forward of said finger beads and of smaller inside diameter than the outside diameters of said finger beads.

9. The combination described in claim 7 wherein:

said sleeve has a front portion lying forward of said fingers and of greater radius than the average radius of said fingers.

10. The combination described in claim 7 wherein:

said clamping ring is a component that is separate from said shell, with said shell and said clamping ring each having an inclined contacting surface in direct facewise engagement with the other inclined contact surface.

11. The combination described in claim 7 wherein:

said clamping ring presses said shield forwardly against said clamp location on said sleeve;

said sleeve front portion has a forwardly-facing stop surface, and said housing includes a stop that directly abuts said stop surface to positively fix the forward axial position of said sleeve.

12. The combination described in claim 7 including:

a cable clamp lying rearward of said clamping ring and having a rear region (6A) and a plurality of tines (6B) with front portions extending at a forward and radially inward incline against said cable jacket.

* * * * *